US006786299B2

(12) United States Patent
Bennett

(10) Patent No.: US 6,786,299 B2
(45) Date of Patent: Sep. 7, 2004

(54) SWIVEL-POWER SCAFFOLD MOBILIZING DEVICE

(76) Inventor: Lamar Bennett, Rt. 2, Box 1305, Lakeland, GA (US) 31635

( * ) Notice: Subject to any disclaimer, the term of this patent is extended or adjusted under 35 U.S.C. 154(b) by 0 days.

(21) Appl. No.: 10/389,011

(22) Filed: Mar. 14, 2003

(65) Prior Publication Data

US 2003/0221907 A1 Dec. 4, 2003

Related U.S. Application Data

(60) Provisional application No. 60/364,757, filed on Mar. 16, 2002.

(51) Int. Cl.[7] ..... E04G 3/16
(52) U.S. Cl. ..... 182/13; 182/12; 182/63.1
(58) Field of Search ..... 182/12, 13, 16, 182/63.1, 148

(56) References Cited

U.S. PATENT DOCUMENTS 3,232,375 A 2/1966 Wartten
3,282,374 A * 11/1966 Allen et al. ..... 182/12
3,575,254 A * 4/1971 Sipos ..... 180/431
3,731,758 A 5/1973 Himba ..... 180/11
4,155,416 A * 5/1979 Ausmus ..... 180/214
4,160,492 A * 7/1979 Johnston ..... 182/2.2
4,475,611 A 10/1984 Fisher ..... 180/6.5
4,662,476 A 5/1987 Ross ..... 182/13
5,139,102 A * 8/1992 Pocapalia ..... 180/19.2
6,119,287 A * 9/2000 Phillips ..... 5/81.1 RP
6,431,314 B1 * 8/2002 Boulanger et al. ..... 182/63.1
6,561,294 B1 * 5/2003 Kamen et al. ..... 180/21
6,668,950 B2 * 12/2003 Park ..... 180/7.1
2001/0038786 A1 * 11/2001 Kim ..... 414/490

* cited by examiner

*Primary Examiner*—Bruce A. Lev

(57) ABSTRACT

A novel and unique user-friendly swivel-power scaffold mobilizing device that provides movement in any direction parallel to the ground and rotation about a vertical axis. The device may be removably secured to a conventional scaffold, providing to power the scaffolding device. The swivel-power scaffold mobilizing device of is designed and configured for use in places that are unsuitable for large, bulky power scaffolds, such as in hallways, office buildings, hospitals and the like.

11 Claims, 4 Drawing Sheets

SWIVEL-POWER SCAFFOLD MOBILIZING DEVICE

This application claim a benefit of 60/364,757 filed Mar. 16, 2002.

BACKGROUND OF THE INVENTION

1. Field of the Invention

The present invention relates generally to a novel and unique user friendly swivel-power scaffold mobilizing device and more particularly to a novel and unique user-friendly swivel-power scaffold mobilizing device.

2. Description of the Prior Art

Scaffold structures are essential for many construction projects such as, wallpapering, painting and installing siding or the like. As such, there are many different types of scaffolding devices currently available. It is well known that present scaffolding devices suffer many shortcomings, such as the need to physically move the walk boards and supports that attach to the ladder when adjusting the position of the scaffolding device. Not only is it time consuming to physically move the scaffold device, it is also very dangerous. Human error due to improper assembly of a scaffold device results in thousands of on-the-job injuries each year, as well as some fatalities.

Numerous attempts have been made to remedy the disadvantages of the present scaffold devices. For instance, various power driven devices have been invented which allow the user to automatically manipulate scaffold devices.

One such example is seen in U.S. Pat. No. 4,475,611 issued to Fisher wherein is disclosed a scaffold propulsion unit comprised of two power wheels located in the center of the scaffold for use with span scaffolds and which provides propulsion for the scaffold. The Fisher power wheels are independently powered; therefore, the device can be operated by directing power by one wheel at a time. In addition, the scaffold may also be rotated by directing the wheels in opposite directions. However, since the two power wheels are located parallel to the scaffold, they are incapable of moving sideways and are thus problematic when parallel parking or moving forward or backward. The Fisher design also needs an extreme battery weight, as it derives its traction from this weight.

Several U.S. Patents provide for a single wheel in the center of the device which is intended to both power and steer the scaffold. An example is U.S. Pat. No. 4,662,476 issued to Ross. The Ross single wheel devices may move the scaffold in any direction however, a single wheel cannot rotate the scaffold and therefore cannot provide for suitable positions for accomplishing the necessary work.

There are some prior scaffold designs with a drive wheel on one end and a steering mechanism on the other end such as may be seen in U.S. Pat. No. 3,232,375 issued to J. T. Warthen and U.S. Pat. No. 3,731,758 issued to Hibma. The devices of these patents will permit the operators to move the units, but the operators will be unable to parallel park their inventions in the user-friendly fashion of the present invention. Both prior inventions must be gradually moved forward and backward by lining up or by making a long gradual run and therefore result in a very time consuming maneuver.

Another example can be seen in U.S. Pat. No. 3,920,096 issued to Fisher wherein is disclosed a vertical hydraulic ram system for a scissors assembly scaffold.

Accordingly, it is seen that there is a need for a swivel-power scaffold mobilizing device which will quickly and easily relocate a scaffold or person by movement in any direction and by rotation. Such a device should also be simple in design and relatively inexpensive to manufacture, so as to enable any contractor, homeowner, or the like, to be able to operate and utilize such a device.

SUMMARY OF THE INVENTION

The present invention provides for a novel and unique user-friendly swivel-power scaffold mobilizing device that provides movement in any direction parallel to the ground and rotation about a vertical axis. The device may be removably secured to a conventional scaffold which provides a means to power the scaffolding device. The swivel-power scaffold mobilizing device of the present invention is designed and configured for use in places that are unsuitable for large, bulky power scaffolds, such as in hallways, office buildings, hospitals and the like.

The novel and unique device of the present invention is comprised of a main body comprised of metal, plastic or the like for durability, which houses the main components of the device. Attached to the main body are two independently powered centrally positioned wheels. Each wheel receives power from any of a variety of drive means, but most preferably by a direct current electric motor. Power for the drive means may be provided by one or more small batteries contained in the main body.

The device of the present invention provides for two different modes of operation, swivel (rotation about a vertical axis) and rigid horizontal translation. This enables the device, including a scaffold, to be quickly and easily moved either forward or backward in a 360-degree circle during operation, as well as providing for ease of relocation. The device also provides for a means to swivel the wheels to manipulate the scaffold device in a sideways manner to achieve a desired location in a minimal time.

Scaffold coupling elements are connected to the main body through a fitting providing free rotation between the scaffold and the main body. This enables a mode wherein the main body is rotated beneath the scaffold while the scaffold position is maintained. A rotation lock or brake is provided to disable the free rotation and fix the scaffold to the main body to enable a mode in which the scaffold may be rotation about a fixed point. In any mode, the main body and scaffold may be rigidly translated by coordinated operation of the two wheels in the direction.

In a preferred embodiment, the present invention includes a scaffold frame removably secured to a main body.

The present invention provides a device adaptable to connect to, or support, a wide range of scaffold devices, roll-about stepladders, mobile stairs, storage devices and other equipment which may benefit from high mobility.

An object of the present invention is a swivel-power scaffold mobilizing device which conforms to conventional forms of manufacture, is of simple construction and easy to use so as to provide a device that is economically feasible, long lasting and relatively trouble free in operation.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments taken in conjunction with the accompanying drawings.

PREFERRED EMBODIMENTS OF THE PRESENT INVENTION

Figure 1:
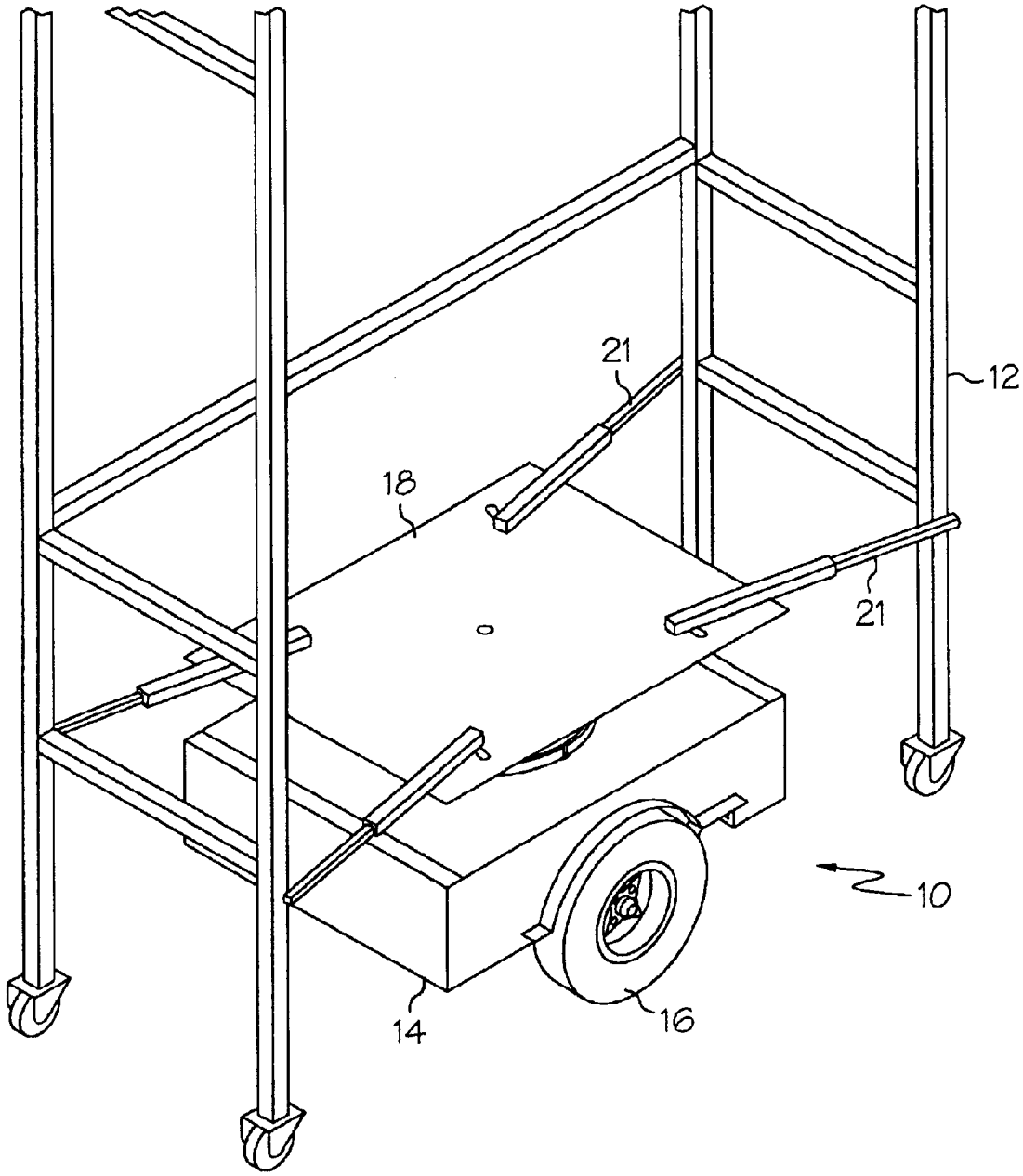
FIG. 1 is a perspective view of one embodiment of the invention in which a mobilizing device is combined with scaffold elements.

FIG. 1 depicts an embodiment of the present invention including a mobilizing device 10 removably secured to a conventional scaffold device 12. The term "scaffold" as used herein means a rigid open support structure for providing an elevated working surface as typified by the structure shown in FIG. 1 and also including other similar structures for the same purpose. The scaffold 12 preferably includes caster wheels supporting the scaffold at the ground to enable the scaffold to be easily pushed into various locations and orientations. The mobilizing device 10 is comprised of a main body 14 comprised of metal, plastic or the like for durability. The main body houses drive components of the device and is supported by, and moved by, two independently driven wheels 16. Connected to the main body 14 is a top plate 18. The top plate 18 is selectively free to either rotate, about a vertical axis, relative to the main body 14, or be rigidly fixed to the main body 14. The enabling structure and manner of these operations are described below. The scaffold 12 is removably secured to the top plate 18 by coupling rails 21. The scaffold may be secured to the coupling rails by any of various known prior devices and methods including threaded brackets, elastic cords, ropes or other means.

As described, the embodiment of FIG. 1 may move the scaffold 12 in a variety of ways. First, the two wheels may be driven in a common direction moving the scaffold in lateral translation (forward or backward). Second, the two wheels may be driven in respectively opposite directions imparting circular motion about a vertical axis. If the top plate 18 is free to rotate relative to the main body 14, the main body 14 can be rotated beneath the scaffold 12 without moving the scaffold to orient the main body 14 and wheels 16 in a second direction. By then driving both wheels 16 in a common direction, the scaffold 12 can be moved laterally in a different translational direction. Also, by fixing the scaffold 12 to the main body 14 and driving the wheels in relatively opposite directions, the scaffold may also be rotated about a vertical axis without translation. The main body is prevented from tipping about the wheels by the support of the scaffold.

The construction of the main body 14 and the drive components are illustrated in FIGS. 2 to 5. The top plate 18 is not shown in FIG. 4. The frame 20 of main body 14 is shown as an assembly of steel sheet-like elements which may be interconnected by threaded fasteners or welded. This specific construction is not required and alternative constructions will be obvious.

Each of two wheels 16 is preferably a rubber or the like tire fitted on a steel rim. Alternative wheel constructions are contemplated depending on the needed load capacity. Each wheel 16 is rotatably secured to one end of an axle shaft 22. The shaft 22 is secured to the underside of the main body frame 20 by brackets 24. A wheel sprocket 26 is secured, concentrically, to the one side of the wheel 16 and spaced from the wheel towards the inside.

Each wheel 16 receives power from a separate independent motor drive assembly including reduction sprockets and connecting chains. For each wheel, an electric motor 28 is mounted within the main body frame 20 with a stub shaft extending parallel to the wheel shaft 22. Secured to the stub shaft of the motor 28 is a small motor drive sprocket 30. A larger first reduction sprocket 32 is mounted on a countershaft 34 that is secured in bearing pillow blocks within the main body frame 20. The drive sprocket 30 and first reduction sprocket 32 are on a common vertical plane and are connected by a drive chain 35 such that operation of the motor 28 drives the first reduction sprocket 32. A slot is the main body frame 20 is provided for the first reduction sprocket to extend below. Also mounted to the countershaft 34 and outside the first reduction sprocket 32 is a second, smaller, reduction sprocket 36. The second reduction sprocket 36 is on a common plane with the wheel sprocket 26. These two sprockets are also connected by a drive chain.

In a prototype device, a ⅛ horsepower, direct current, 12 volt reversible motor operating at 2350 RPMS (revolutions per minute) was provided. Power was provided by a 12 volt motorcycle type battery (ref. 31 in FIG. 5) mounted within the main frame body. The sprockets were sized to reduce the rotational speed to about 35 to 50 RPMS at the wheels (for 10 to 8 inch diameter wheels, respectively). This was found to be a preferred wheel speed for comfortable operation in most applications. Separate motor controls were provided for each wheel's motor. The inherent binding effect of the electric motors and the reduction provided an added benefit of braking of the wheels when unpowered, thus adding stability. This drive assembly is but one of many methods and structures for providing independent drive means to each wheel. Other equivalent means will become obvious to one skilled in the art. However, advantages of the embodiment shown are its simplicity, portability and light weight. It is desirable to include a coupling or other means in the drive system between the motor and the wheels to enable decoupling of these elements when it is necessary to move the device without power. The total weight of the prototype device was less than 100 pounds which allowed it to be moved and loaded or unloaded from a transporting vehicle by a single person. The prototype device was capable of moving a single person on a small metal scaffold.

Figure 6:
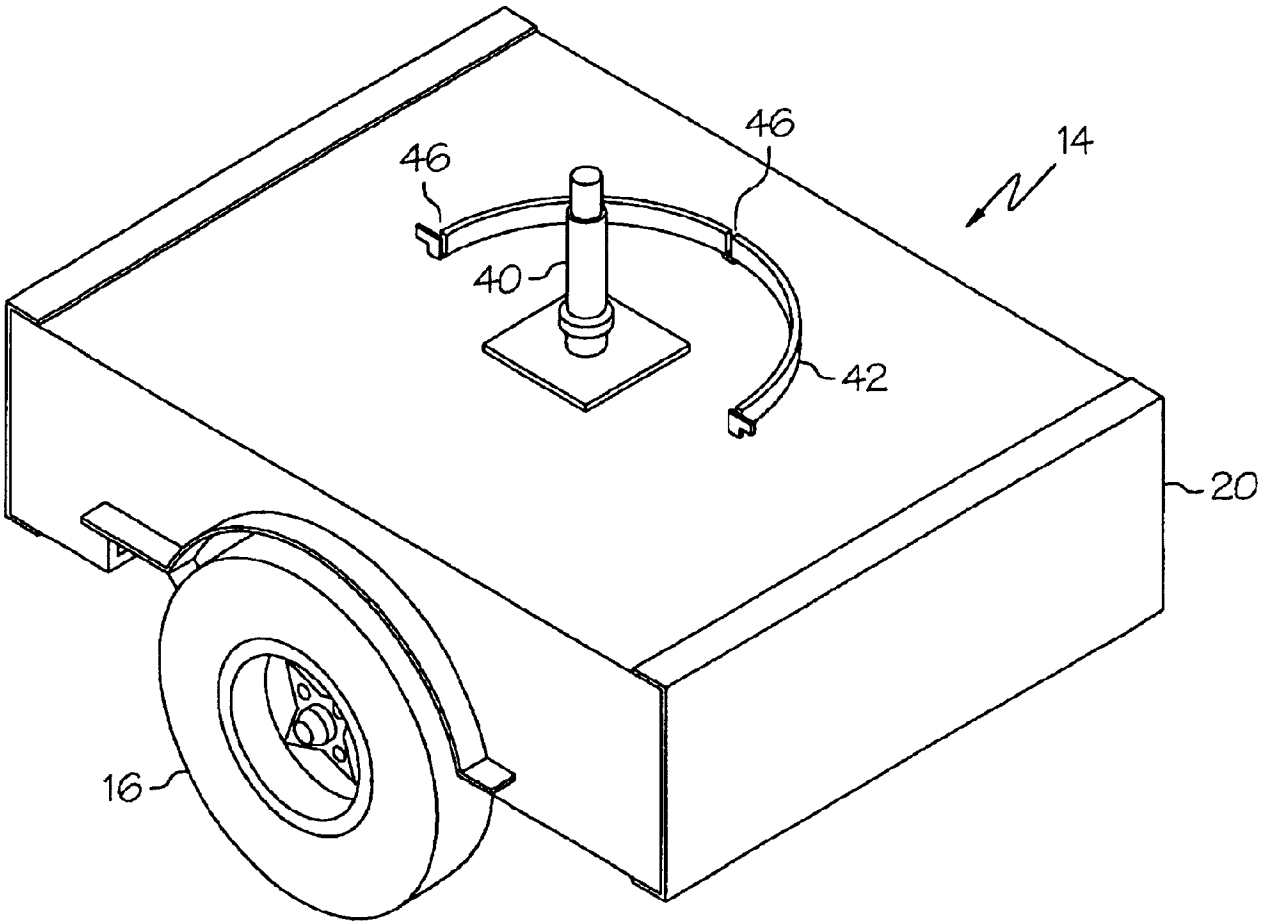
FIG. 6 is a perspective view of the main body of the embodiment of FIG. 1 showing the rotating elements and brake for the top plate.

In order to provide for the novel and unique swivel rotating operation of the present invention a top plate 18 is rotatably connected to the top of the main body frame 20. FIG. 6 is a perspective view of the top of the main body 20 with a secured spindle and hub assembly 40. The spindle is attached through a flange, as shown, to the main body. A hub is secured over the spindle and bearings to allow the hub to rotate freely about a vertical axis. The spindle and hub may have tapered bearing or thrust bearings to vertically support the hub and top plate. This construction is similar to that employed in vehicle wheel bearings and other applications.

The hub of the hub assembly 40 attaches to the top plate by means of threaded fasteners which extend through the top plate 18 and screw into the hub. The top plate 18 must be rigidly secured to the hub. This configuration provides a relative rotation means between the main body 14 and the top plate 18 which enables the great variety of mobile operations herein described and desired.

The center vertical axis of the hub assembly 40 preferably passes through the centerline of the wheels' axis of rotation (centerline of axle shaft). With this configuration, equal rotation of the two wheels 16 in opposite directions will provide rotation about the vertical axis of the hub assembly 40 without lateral translation of the hub assembly 40 or the main body 14.

To the top plate 18 are secured coupling rails 21 as described relative to FIG. 1. The coupling rails 21 are preferably adjustable with regard to angle and length to accommodate various scaffold structures. Preferably also, the coupling rails 21 have sufficient flexibility to react and transmit only a portion of the scaffold weight through the hub assembly and the main body to the wheels 16. Other configurations of the top plate and coupling arms are contemplated to serve the same function: to provide a connection means between the hub assembly 40 (as a rotation means) and the scaffold elements. In extension of this idea, in alternative embodiments, the top plate and coupling arms are integrated into the scaffold elements to create an integrated mobile scaffold.

Figure 3:
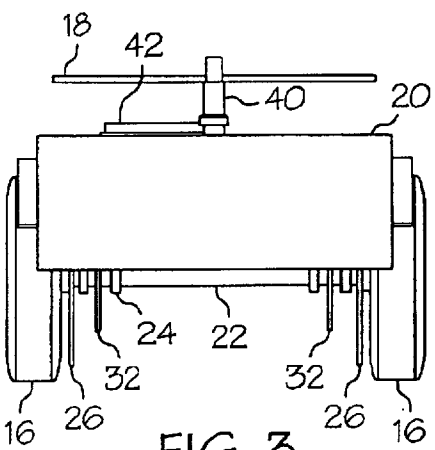
FIGS. 2, 3 and 4 are side, end and top views, respectively, of elements of the main body of a mobilizing device according to the embodiment of FIG. 1.
Figure 2:
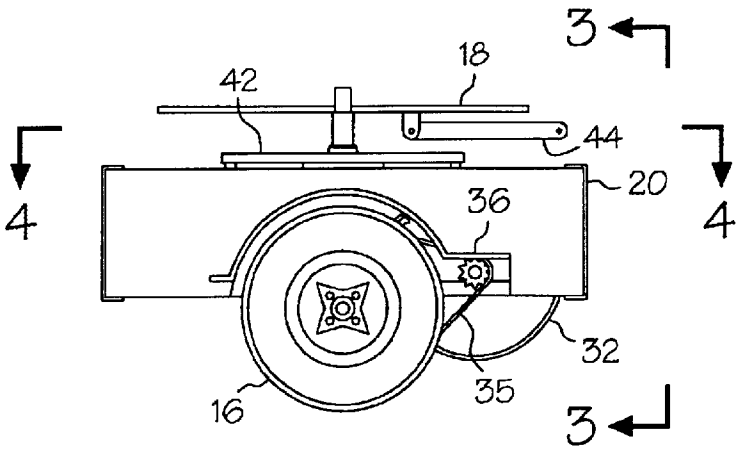
Figure 4:
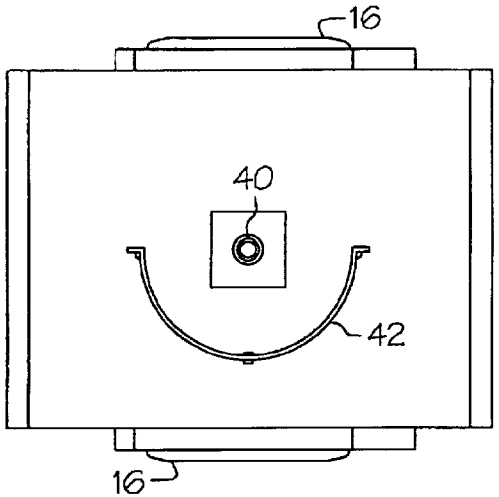
Figure 5:
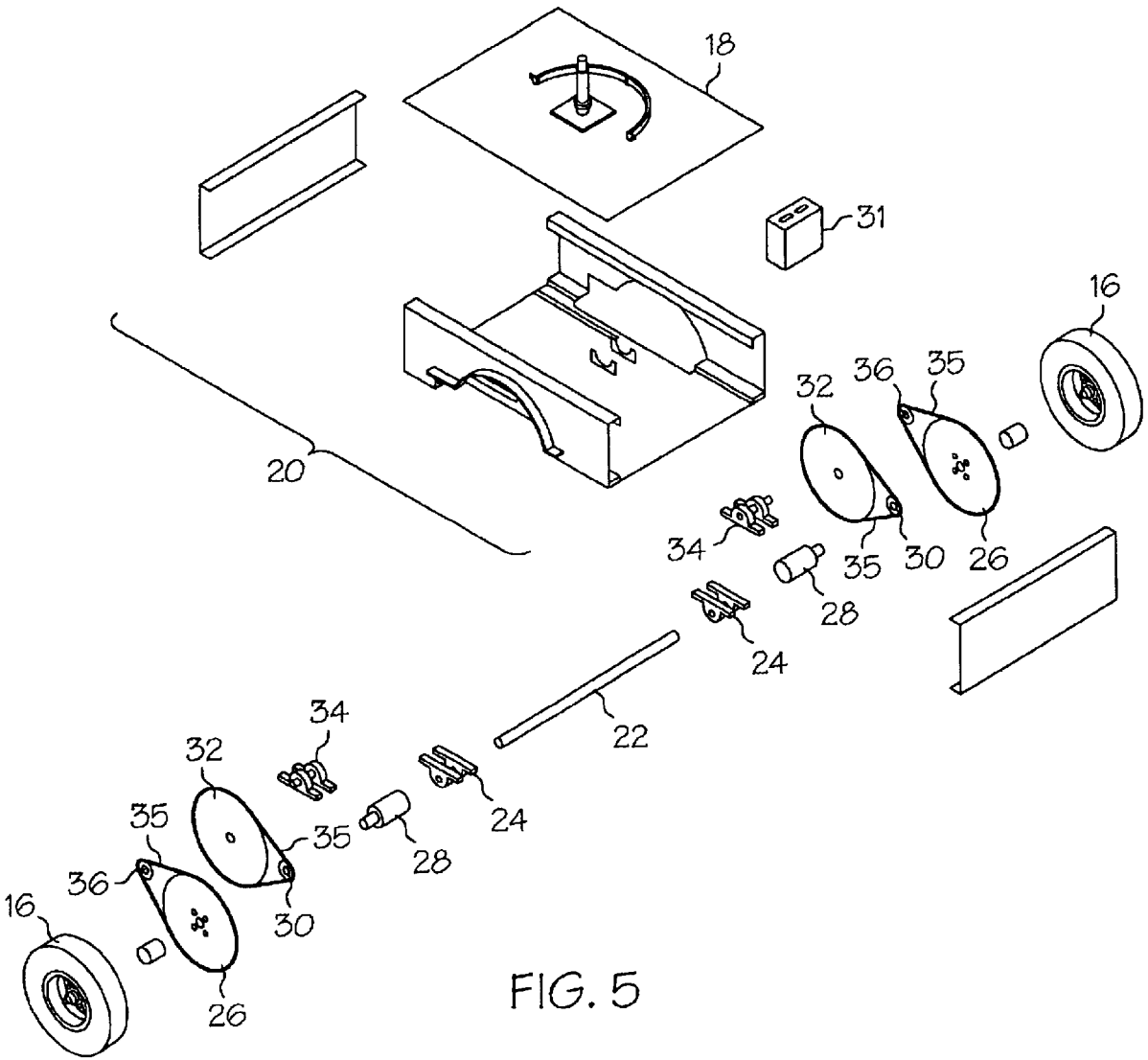
FIG. 5 is an exploded view of elements of the main body and wheels of the embodiment of FIG. 1 of present invention including the drive elements.

To enable powered rotation of an attached scaffold, it is necessary to disable the rotation means or lock the top plate to the main body. FIGS. 2 and 3 show a brake band 42 and a brake blade 44 which accomplish this locking function. The rigid brake band 42 is comprised of a thin metal strap secured to the top of the main body frame 20 in such a fashion as to form a 180 plus degrees configuration. The brake band 42 has multiple notches 46 in the top edge to receive the brake blade 44 which is sized for the purpose. The brake blade 44 is an elongated and pivotably secured at one end to the top plate 18. When the second end of brake blade is lowered into the notches of the brake band 42 it is captured there and prevented from rotating about the hub assembly. The top plate 18 is thereby also locked from rotation relative to the main body 14. Thus, when the brake blade 44 is engaged in the brake band 42, an attached scaffold will move in the same rotational direction as the main body 14. Preferably, there are a plurality of notches spaced 90 degrees apart relative to the hub assembly axis. A second end of the brake blade 44 extends beyond the top plate 18 for access and control. A cord or lever there attached may manipulate the brake band to position the brake blade 44 out or in the brake band notches 46 as needed. This provides manual operation of this locking function by the user. Preferably, the brake blade 44 is fastened to the bottom side of the top plate 18 and supported by at least one set of by "L" brackets to resist side forces when engaged in the brake band 42. This construction of a rotation locking means only one example of such structures that may be used to accomplish the same function as required in the invention. Other equivalent means of locking the relative rotation of the top plate 18 and main body 14 will become obvious to those skilled in the art.

To enable a user to control the mobilizing device 10 while the user is located on the attached scaffold, a control switch unit is provided that includes a separate switch corresponding to each wheel assembly. Each switch has at least two positions associated with the two directions of rotation of the respective motor and wheel. The control switch unit provides for easy attachment to the scaffold for access by a user. Other controls for carrying out the modes of operation described herein are also available and contemplated as within the invention.

With the unique construction defined above, a mobilizing unit may be built that enables movement of a scaffold or similar structure in any lateral direction from a single point without rotation of the structure. At the same time rotation at a point without translation is likewise enabled. This is accomplished with a device that is simple and portable. Note that in the present device the entire weight of the scaffold and associated supported weight is not borne by the mobilizing unit 10, but is principally supported by the scaffold structure itself. This reduces the requirements of the mobilizing unit 10 and therefore its consequent complexity, cost, and weight. A portion of the scaffold weight may be transmitted through the top plate 18 or equivalent structure to the wheels 16 to add to traction.

The foregoing description of the preferred embodiment of the present invention has been presented for purposes of illustration and description. The embodiment illustrated herein was chosen and described in order to explain the principles of the invention and its practical application to thereby enable others in the art to best utilize the invention in various embodiments and with various modifications as are suited to the particular use contemplated. The description is not intended to be exhaustive or to limit the invention to the precise form disclosed, and obviously many modifications and variations are possible in light of the above teaching. It is intended that the scope of the invention be defined by the following claims.

I claim:

1. A scaffold mobilizing device comprising:

a main body;

two wheels mounted on the main body and on a common centerline of rotation, each wheel having an independent drive;

a scaffold coupling rotatably secured to the main body about a vertical axis passing transversely through the wheels' centerline of rotation, the coupling lockable against rotation relative to the main body;

such that the main body may be driven, by the wheels, laterally, or in rotation about the vertical axis without movement of the scaffold coupling.

2. The device of claim 1, and wherein:

each wheel independent drive includes an electric motor.

3. The device of claim 2, and wherein:

each electric motor is a direct current electric motor; and each independent drive further comprises speed reduction means for reducing the rotational speed of the motor, the reduction means connected between the motor and wheel.

4. The device of claim 3, and wherein:

the reduction means comprises sprockets and chains.

5. The device of claim 2, and further comprising:

a battery supported by the main body and providing power to each motor.

6. The device of claim 1, and further comprising:

a spindle secured to the main body and a hub secured to the scaffold coupling, the spindle and hub connected by bearings allowing rotation about a vertical axis.

7. The device of claim 6, and further comprising;

a manual brake for locking the coupling against rotation relative to the main body.

8. The device of claim 1, and wherein:

the wheels have a outer diameter in the range of eight to ten inches.

9. The device of claim 1, and wherein:

the device has a total weight of less than 100 pounds.

10. A device for mobilizing an elevated support surface comprising;

a main body;

two wheels mounted on the main body and on a common centerline of rotation;

two reversible direct current motors mounted within the main body, each motor connected to a respective wheel to independently drive the wheels;

a battery connected to the motors;

a top plate above the main body;

a spindle and hub connected between the main body and the top plate and providing relative rotation between the main body and top plate about a vertical axis, the vertical axis passing through the common centerline of the wheels;

means for securing a structure to the top plate;

lock means for selectively preventing relative rotation between the main body and the top plate.

11. A scaffold mobilizing device comprising:

a main body;

two wheels mounted on the main body and on a common centerline of rotation, each wheel having an independent drive;

a scaffold coupling rotatably secured to the main body, the coupling lockable against rotation relative to the main body;

a spindle secured to the main body and a hub secured to the scaffold coupling, the spindle and hub connected by bearings allowing rotation about a vertical axis; and a manual brake for locking the coupling against rotation relative to the main body;

wherein the manual brake comprises:

a brake band secured to the main body and having a plurality of upward opening notches, and a brake blade secured to the coupling and receivable in the notches;

such that the main body may be driven, by the wheels, laterally or in rotation about a vertical axis.

* * * * *